United States Patent [19]

Leone et al.

[11] Patent Number: 4,654,490

[45] Date of Patent: Mar. 31, 1987

[54] REVERSE LOOP CIRCUIT BREAKER WITH HIGH IMPEDANCE STATIONARY CONDUCTOR

[75] Inventors: David A. Leone, Aliquippa; Douglas C. Marks, North Braddock, both of Pa.

[73] Assignee: Westinghouse Electric Corp., Pittsburgh, Pa.

[21] Appl. No.: 835,669

[22] Filed: Mar. 3, 1986

[51] Int. Cl.[4] ..... H01H 33/20

[52] U.S. Cl. ..... 200/147 R; 200/144 R; 335/16; 335/195; 335/147

[58] Field of Search ..... 200/147 R, 144 R; 335/195, 16, 147

[56] References Cited

U.S. PATENT DOCUMENTS

| | | | |
|---|---|---|---|
| 3,555,471 | 1/1971 | Mitskevich et al. | 200/147 R |
| 4,158,827 | 6/1979 | Bratkowski et al. | 335/195 |
| 4,513,268 | 4/1985 | Seymour et al. | 335/195 |
| 4,540,961 | 9/1985 | Maier | 335/16 |

*Primary Examiner*—Robert S. Macon

*Attorney, Agent, or Firm*—L. P. Johns

[57] ABSTRACT

A reverse loop circuit breaker characterized by a movable contact mounted on a contact-carrying arm movable between open and closed positions of a stationary contact that is mounted on one leg of a U-shaped conductor with another leg secured to the circuit breaker housing, an insulating block between the legs and including a pair of separable block portions having oppositely facing grooves for receiving edge portions of at least one leg to restrain its deflection, and means for securing the block portions together.

11 Claims, 3 Drawing Figures

REVERSE LOOP CIRCUIT BREAKER WITH HIGH IMPEDANCE STATIONARY CONDUCTOR

CROSS-REFERENCE TO RELATED APPLICATION

This application is related to the copending application, Ser. No. 835,670, filed Mar. 3, 1986, entitled "Circuit Breaker With Contact Support and Arc Runner" of which A. E. Maier, D. C. Marks and D. A. Leone, assigned to the assignee of this application.

BACKGROUND OF THE INVENTION

1. Field of the Invention

This invention relates to reverse loop circuit breakers and, more particularly, it pertains to an insulating support for a contact supporting U-shaped conductor.

2. Description of the Prior Art

Circuit breakers and, more particularly, molded case circuit breakers are well known in the prior art and are provided with operating mechanisms that include movable contacts designed to provide protection for an electrical circuit or system against electrical faults, such as electrical overload conditions, low level short circuit or fault circuit conditions, and, in some cases, high level short circuit or fault current conditions. Prior art circuit breakers have employed a trip mechanism for controlling the movement of an overcenter toggle mechanism to separate a pair of electrical contacts upon an overload condition or upon a short circuit or fault current condition. Such trip mechanisms have included a bimetal movable in response to an overload condition to rotate a trip bar, resulting in the movement of the overcenter toggle mechanism to open a pair of electrical circuit breaker contacts.

A difficult performance requirement for circuit breakers employing thermal tripping elements (bimetals) is the self-protection of the tripping element during short circuit conditions. Bimetal distortion must be kept to a minimum so that the circuit breaker will perform satisfactorily under normal tripping conditions after being subjected to multiple short circuits. The magnitude of this problem increases as the circuit breaker frame size decreases; that is, as the bimetal becomes more fragile. For circuit breakers of low ratings, such as 15 to 20 amperes, the available fault current must be reduced significantly so that the bimetals will survive.

SUMMARY OF THE INVENTION

In accordance with this invention, a circuit breaker is provided which comprises an insulating housing having line and load terminals, a circuit breaker structure within the housing having a releasable member and having stationary and movable contacts operable between open and closed positions, a trip mechanism movable to release the releasable mechanism in response to the occurrence of a predetermined electric current overload, a contact carrying arm and pivotally mounted on this circuit breaker structure for movement through a path of travel between the open and closed positions, arc extinguishing means around the path of travel of the arm and including spaced arc-absorbing plates, a U-shaped conductor extending from one of the terminals and having first and second legs, the latter of which supports the stationary contacts, the contact-carrying arm and the second leg being substantially parallel and susceptible to repulsion magnetic forces when the circuit is closed, a support bracket between the first and second legs and including a block of two separable portions of electrically insulating material between the legs, the conductor being composed of an alloy having high electrical resistance and an end portion of the second leg extending to a position proximate to the arc-absorbing plates, whereby the end portion serves as an arc runner between the stationary contact and the plates, the separable portions including oppositely facing notches for receiving corresponding edge portions of the second leg to restrain the second leg against deflection due to repulsion magnetic forces, and electrical insulating strips located between the second leg and the arm and the separable portions and including oppositely facing groove means for receiving corresponding edge portions of the strip to retain the corresponding edge portions of the strip to retain the strip in place.

The advantage of the device of this invention is that an economical reverse loop stationary conductor is provided which introduces a relatively high impedance into the circuit breaker and thereby effectively reduces peak let through current and $I^2t$ during short circuit conditions, thus significantly reducing the damage to the bimetal of the circuit breaker.

DESCRIPTION OF THE PREFERRED EMBODIMENT

Figure 1:
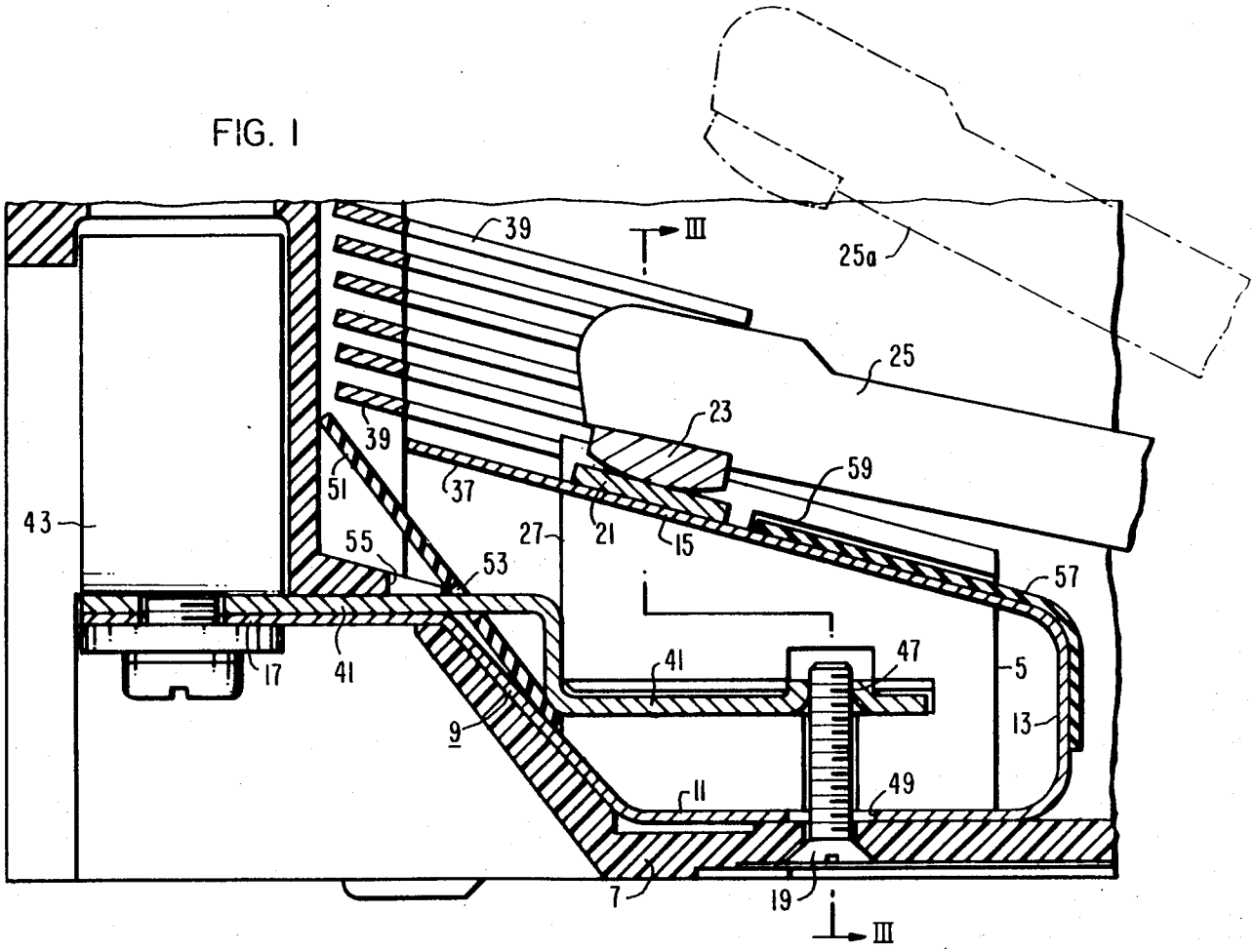
FIG. 1 is a fragmentary sectional view through the contacts of a reverse loop circuit breaker showing a support block for the U-shaped conductor.

The device of this invention is a support bracket or block 5 which is contained within a reverse loop stationary conductor of a circuit breaker, such as disclosed in U.S. Pat. No. 4,528,531, issued July 9, 1985, and which is incorporated herein by reference. Among other things, the circuit breaker comprises a molded base 7 which supports a conductor 9 which as shown in FIG. 1 is a reverse loop stationary conductor having a first leg 11, a bight portion 13, and a second leg 15. The conductor 9 includes and is preferably integral with a terminal end portion 17 and is retained in place on the base by a screw 19.

A stationary contact 21 is mounted on the second leg 15 and cooperates with a movable contact 23 which is mounted on a contact-carrying arm 25. The contact-carrying arm 25 is movable between the contact closed position (FIG. 1) and a contact open position of the arm 25*a*.

When the contacts 21, 23 are closed under normal operating conditions below a predetermined electric current overload, the U-shaped conductor 9 sustains repulsion magnetic forces between the first and second legs 11, 15 which forces tend to separate the legs from each other. Simultaneously, a second repulsion magnetic force is sustained between the second arm 15 and the contact-carrying arm 25 which force tends to repel the leg and arm apart, whereby the leg 15 is impelled downwardly from the arm. These opposing repulsion magnetic forces affect the second leg 15 in opposite directions and thereby tend to separate the contacts 21, 23 inadvertently.

Figure 2:
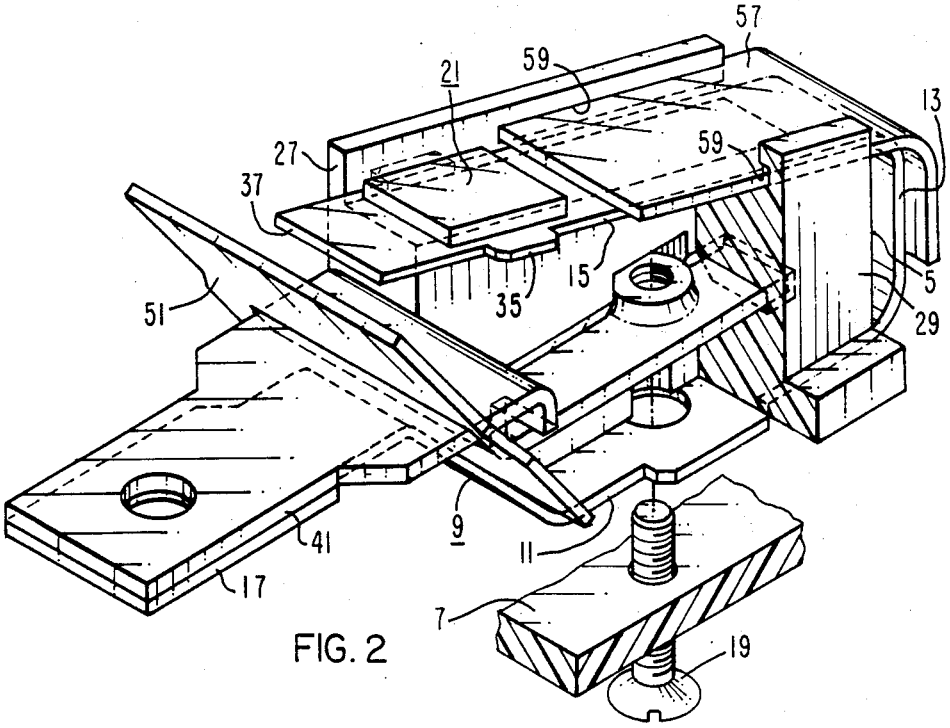
FIG. 2 is an isometric view showing the manner in which the support block and U-shaped conductor are fitted together.
Figure 3:
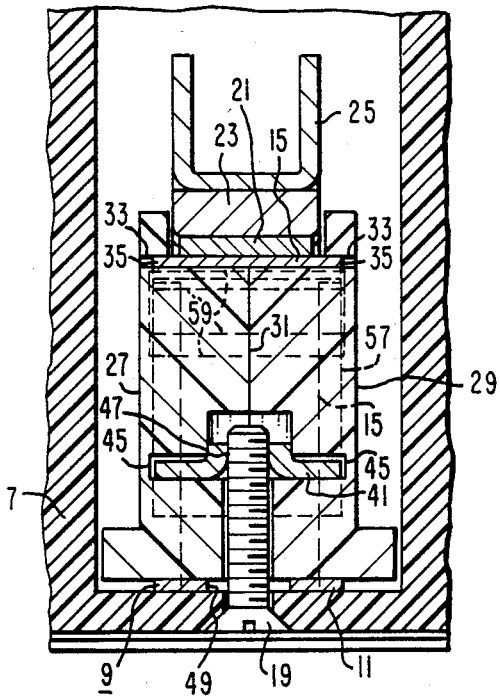
FIG. 3 is a sectional view taken on the line III—III of FIG. 1.

In accordance with this invention, the bracket 5 stabilizes the second leg 15 against the vertical motion. The bracket 5 is preferably a solid block of electrically insulating material such as glass-filled polyester. The bracket or block 5 is preferably comprised of two half block portions 27, 29 (FIG. 3) having abutting surfaces at a parting line 31. The half block portions 27, 29 have oppositely facing aligned slots 33 in which oppositely extending ears 35 (FIG. 2) in which oppositely extending ears 35 extend from opposite edges of the second leg 15. In this manner, the leg 15 is prevented from flexing upwardly or downwardly in response to oppositely disposed repulse magnetic forces.

Moreover, the second leg 15 includes an end portion 37 extending beyond the contact 21 and in proximity of plates 39 of an arc extinguishing means for arc chute. When the contact-carrying arm 25 moves to the position 25*a* and electric arc normally occurs between the separating contacts 21, 23 which arc moves from the contact 21 onto the end portion or arc runner 37 from where it is transferred to the arc plates 39 for extinguishment.

Inasmuch as the conductor 9 is one of relatively high impedance to effectively reduce the peak let-through current and $I^2t$ during short circuit conditions to reduce the damage to a bimetal of the circuit breaker, it is comprised of a relatively thin strip of a high resistance alloy such as nickel chromium. Thus, the available fault current is limited. On low ratings (15 to 20 amperes), the available fault current must be reduced significantly so that the bimetal survives. To mechanically support the terminal portion 17 of the conductor 11, a terminal strip 41 is provided at a line terminal 43 (FIG. 1). The terminal strip 41 extends into oppositely-disposed slots 45 (FIG. 3) of the half blocks 27, 29. The screw 19 extends through the base 9, the conductor 11, and through a threaded hole 47. The screw in combination with the strip 41 holds the half portions 27, 29 in place, thereby maintaining the assembly of the half portions and the second leg 15 intact. To avoid shorting out of the reverse loop, the screw 19 (FIG. 3) extends through an oversized hole 49 in the first leg of the conductor thereby providing clearance between the first leg and the middle screw 19, the upper end of which is secured to the metal strip 41.

An insulating barrier 51 includes a hole 53 through which the terminal strip 41 extends where it is retained in place between the conductor 9 and the strip 41. In addition, the upper end of the barrier 51 extends between the plates 39 of the arc chute and the terminal strip 41 to prevent arc gases from exiting from the breaker through a terminal slot 55 in the housing, thereby avoiding possible arcing between the plates 39 and the assembly of the conductor 9 and the terminal strip 41.

In addition, an insulating barrier 57 is disposed over the conductor 11 and between the conductor and the contact-carrying arm 25 to insulate the second leg 15 from the conductor 25. The insulating barrier 57 extends over the second leg 15 and downwardly over the bight portion 13 of the conductor 9. It is retained in place by opposite slots 59 in the upper sides of the facing half block portions 27, 29 by opposite edge portions of the barrier disposed therein.

In conclusion, the reverse loop circuit breaker of this invention provides a relatively high impedance into the breaker and thereby effectively reduces the peak let-through current and the $I^2t$ during short circuit conditions thus significantly reducing damage to other parts of the circuit breaker such as a bimetal strip.

What is claimed is:

1. A circuit breaker comprising:

an insulating housing having line and load terminals;

a circuit breaker structure within the housing and having stationary and movable contacts operable between open and closed positions;

the structure including a releasable member;

a trip mechanism movable in response to the occurrence of a predetermined electric current overload to release the releasable member;

the circuit breaker structure including a contact arm carrying the movable contact;

a U-shaped conductor comprising first and second legs;

the first leg being electrically connected to one of the terminals and the second leg carrying the stationary contact;

the U-shaped conductor being composed of flexible metallic material and susceptible to first repulsion magnetic forces conducive to limited deflection of the legs when the circuit is closed through the circuit breaker;

the contact carrying arm, and the second leg being substantially parallel and susceptible to second repulsion magnetic forces when the circuit is closed; and a bracket for supporting the first and second legs in fixed positions and including a block of electrically insulating material between the legs, whereby the second leg is retained against deflection.

2. The circuit breaker of claim 1 in which the block includes an assembly screw for holding the block in place between the legs.

3. The circuit breaker of claim 2 in which the block comprises two separable portions of electrical insulating material.

4. The circuit breaker of claim 3 in which the block comprises two separable half portions.

5. The circuit breaker of claim 4 in which the separable portions include oppositely facing surface means for receiving opposite edge portions of the legs.

6. The circuit breaker of claim 5 in which the separable portions include aligned slots and in which the first leg extends from one of the terminals and support means for the assembly of the terminals and first leg and including a metal strip extending into the aligned slots.

7. The circuit breaker of claim 6 in which the assembly screw engages a threaded aperture in the strip and the assembly of the strip and screw clampingly retaining the separable portions together when the screw engages the strip.

8. A circuit breaker comprising:

an insulating housing having line and load terminals;

a circuit breaker structure within the housing having a releasable member and having stationary and movable contacts operable between open and closed positions;

a trip mechanism movable to release the releasable mechanism in response to the occurrence of a predetermined electric current overload;

a contact-carrying arm for the movable contact and pivotally mounted on the circuit breaker structure for movement through a path of travel between the open and closed positions;

arc extinguishing means around the path of travel of the arm and including spaced arc-absorbing plates;

a U-shaped conductor extending from one of the terminals and having first and second legs, the latter of which supports the stationary contact;

the contact-carrying arm and the second leg being substantially parallel and susceptible to repulsion magnetic forces when the circuit is closed;

a support bracket between the first and second legs and including a block of electrically insulating material between the legs; and the conductor being composed of an alloy having high electrical resistivity and an end portion of the second leg extending to a position proximate to the arc-absorbing plates, whereby the end portion serves as a arc runner between the stationary contact and the plates.

9. The circuit breaker of claim 8 in which the block includes two separable portions of electrically insulating material.

10. The circuit breaker of claim 9 in which the separable portions include oppositely facing notch means for receiving corresponding edge portions of the second leg to restrain the second leg against deflection due to repulsion magnetic forces.

11. The circuit breaker of claim 10 in which electrical insulation strips are located between the second leg and the arm and the separable portions and including oppositely facing groove means for receiving corresponding edge portions of the strip to retain the strip in place.

* * * * *